US006461220B1

(12) United States Patent
Ming

(10) Patent No.: US 6,461,220 B1
(45) Date of Patent: Oct. 8, 2002

(54) ADHESIVE FUNNY JUMPING TOY

(76) Inventor: Tay-Shu Ming, PO Box 82-144, Taipei (TW)

( * ) Notice: Subject to any disclaimer, the term of this patent is extended or adjusted under 35 U.S.C. 154(b) by 0 days.

(21) Appl. No.: 09/714,279

(22) Filed: Nov. 17, 2000

(51) Int. Cl.[7] ..... A63H 33/00
(52) U.S. Cl. ..... 446/486; 446/431; 446/487
(58) Field of Search ..... 446/486, 487, 446/431

(56) References Cited

U.S. PATENT DOCUMENTS 4,828,532 A * 5/1989 Tarlow et al. ..... 446/486
5,692,737 A * 12/1997 Perlsweig ..... 446/486

* cited by examiner

*Primary Examiner*—Derris H. Banks
*Assistant Examiner*—Dmitry Suhol
(74) *Attorney, Agent, or Firm*—Leong C. Lei

(57) ABSTRACT

The invention relates to an adhesive funny jumping toy where the adhesion of the adhesive bodies, the elasticity of the spring coil, the gravity and the free fall of the toy produce continuous rolling and jumping along the vertical surface without free drop so as to attract kids' interest and attention.

2 Claims, 7 Drawing Sheets

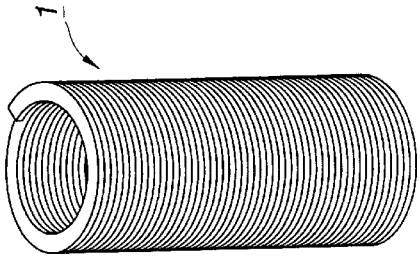
PRIOR ART
Fig.2
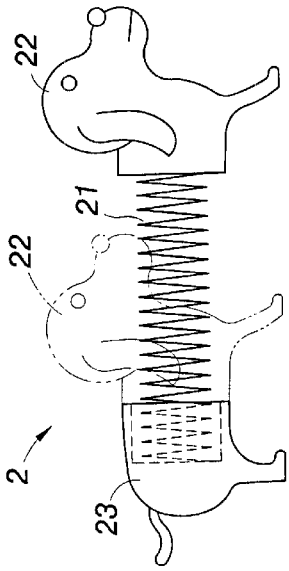
PRIOR ART
Fig.1
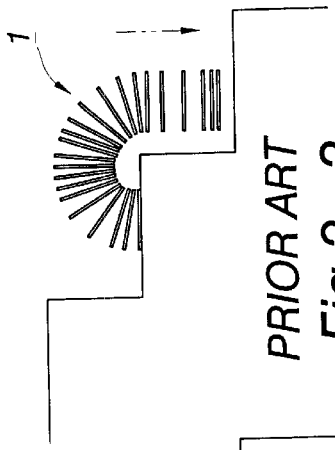
PRIOR ART
Fig.3~3
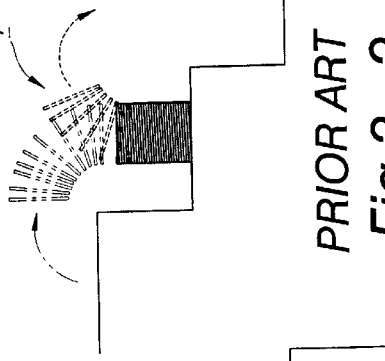
PRIOR ART
Fig.3~2
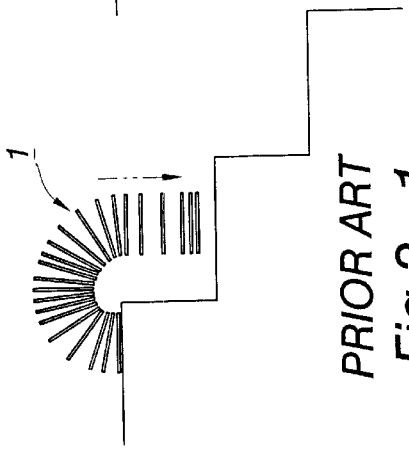
PRIOR ART
Fig.3~1

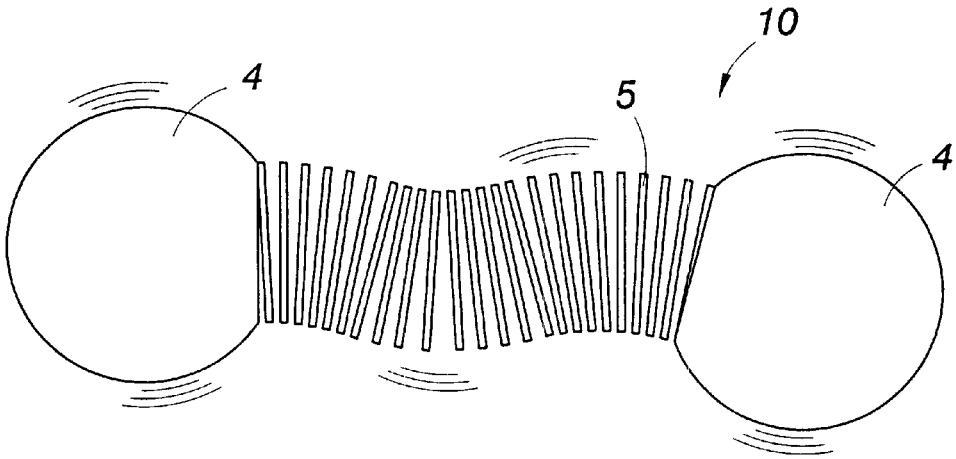
Fig.7~1
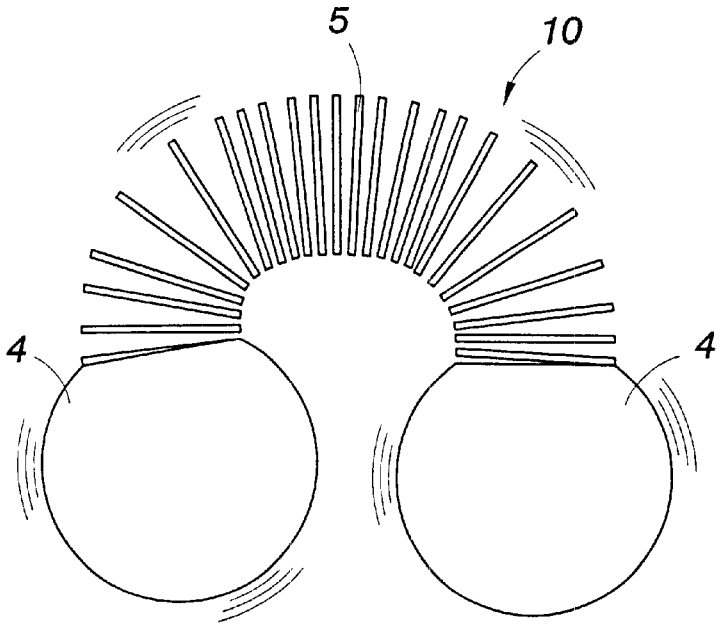
Fig.7~2

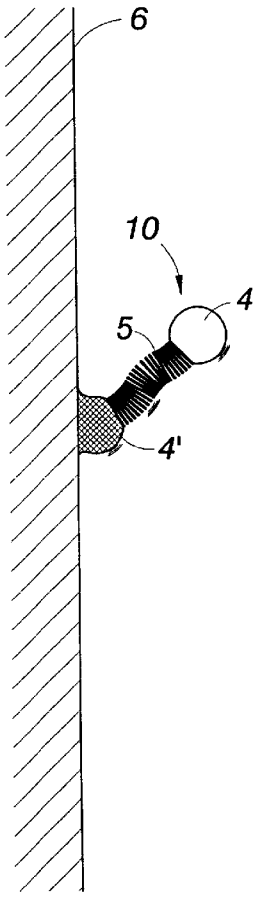
Fig.8~4
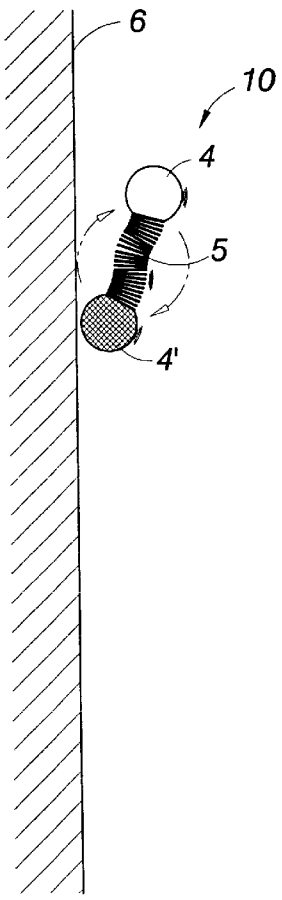
Fig.8~3
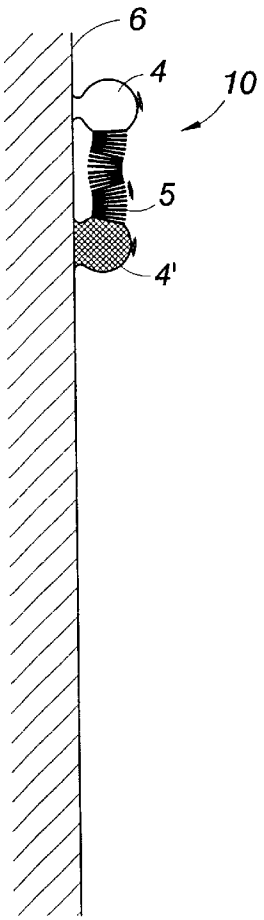
Fig.8~2
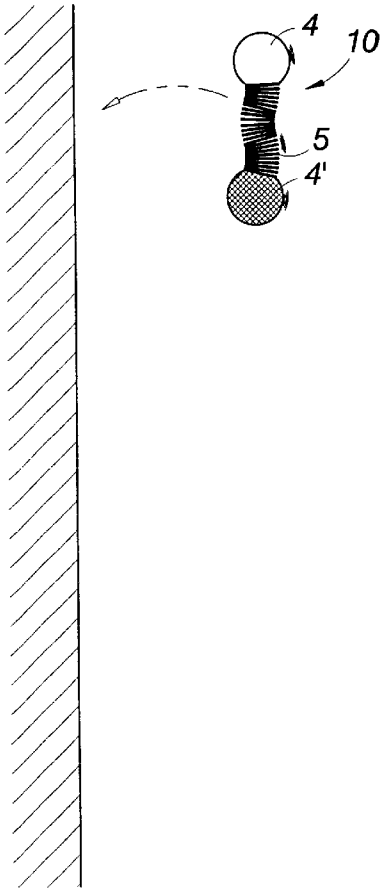
Fig.8~1

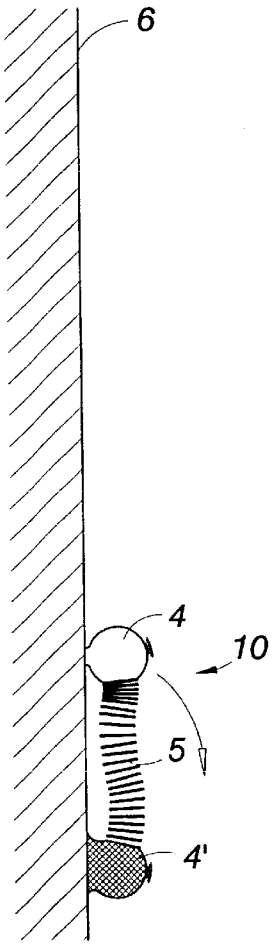
Fig.8~8
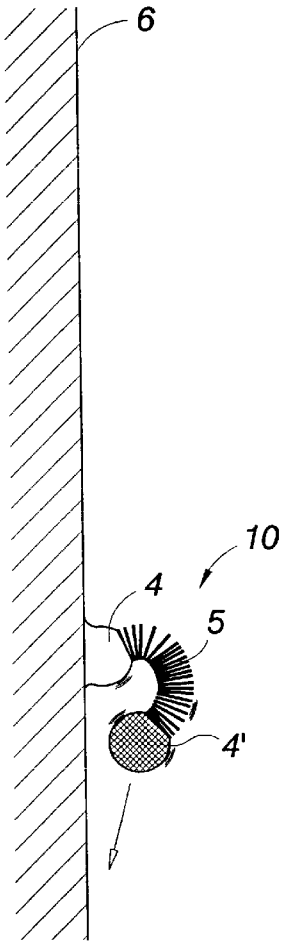
Fig.8~7
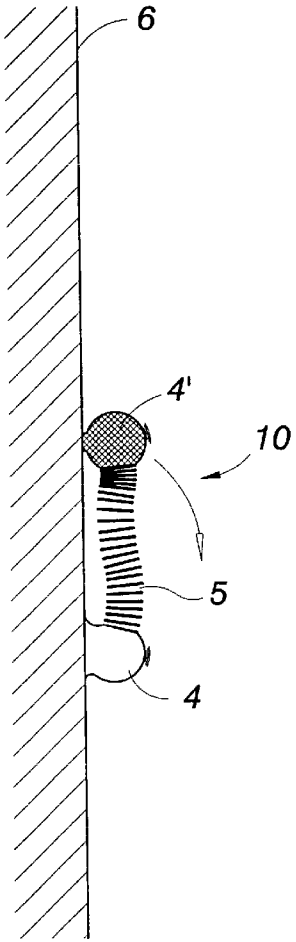
Fig.8~6
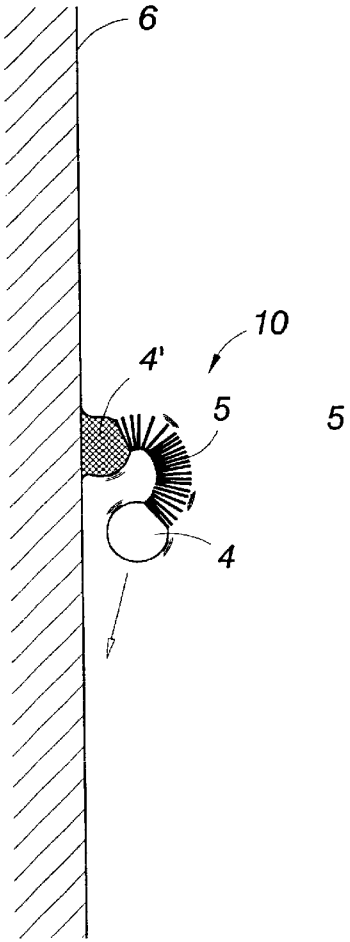
Fig.8~5

ADHESIVE FUNNY JUMPING TOY

BACKGROUND OF THE INVENTION

As shown in the FIGS. 1 and 2, the conventional kid's toys in most cases are made of a major component of spring. The FIG. 1 illustrates an extendible toy 2 comprising an extendible spring 21 and two connectors 22 and 23, where the connector 22 forms the front body of an animal and the connector 23, the rear body of an animal. When in full compression, the toy demonstrate a complete animal, while pulled, it becomes an extended animal with a funny long body. The FIG. 2 displays a jumping toy 1, composed of a very soft long spring coil with a staircase as its walkway, it jumps down from the higher tread to the lower tread in a continuous manner as shown in FIG. 3-1, -2 and -3. The spring toy embraces good elasticity, when the gravity is biased, it becomes a free fall, so moving down along the staircase steps. However, the toy is designed with no brilliant pattern and decoration, presenting little attraction to the kids.

The toy described in this invention greatly differs from the aforesaid two embodiments and the dominant difference is addressed in the statement.

BRIEF DESCRIPTION OF THE INVENTION

An adhesive funny jumping toy of the invention mainly comprises a extendible spring coil, two connectors, and two adhesive bodies, where two connectors are fastened to the two ends of the spring coil and two adhesive bodies are inlaid onto the two connectors. The adhesive bodies have extreme features of adhesion, extension and recovery. When being thrown onto the vertical smooth surface (such as glass, mirror, plastic, metal or enamel panel), the toy temporarily sticks to the surface, by the effect of spring twist and free fall, it continue turning, rolling and jumping down irregularly. In particular, the adhesive bodies can be made in varying patterns, such as carton pet, animal, ET, so making it funny with diversity.

BRIEF DESCRIPTION OF THE DRAWINGS

FIG. 1 is a plan showing the conventional toy with compressed and extended action.

FIG. 2 is the elevation of the conventional spring toy.

FIGS. 3~1,3 shows the continuous actions produced by the spring toy shown in FIG. 2.

FIGS. 7~1,2 is the schematic diagram of the jumping toy of the invention.

FIGS. 8~1 through 8 illustrate the continuous actions of the jumping toy of the invention.

DETAILED DESCRIPTION OF THE INVENTION

The invention will be expounded in great detail with aid of embodiments as the drawings show.

Figure 4:
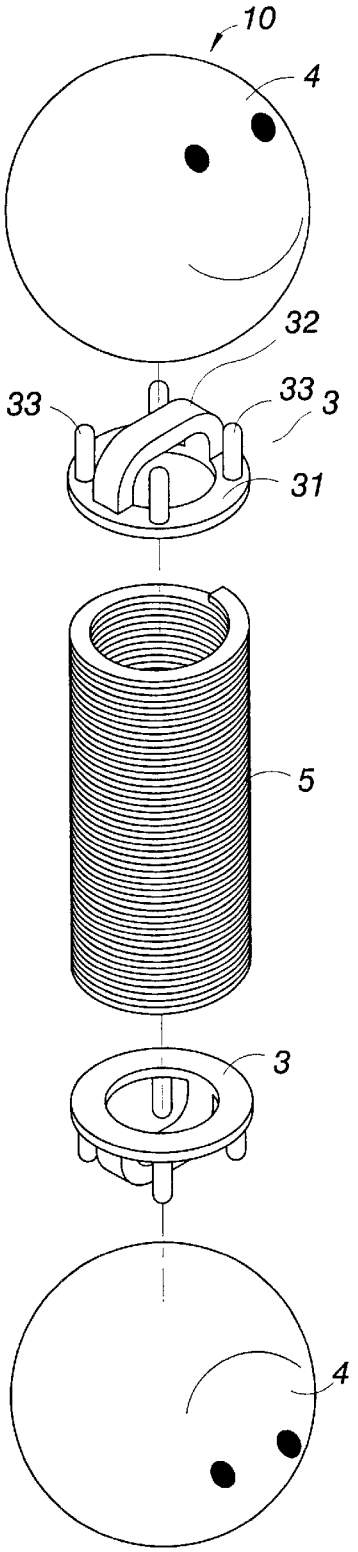
FIG. 4 is the stereo disassembly of the jumping toy of the invention.
Figure 5:
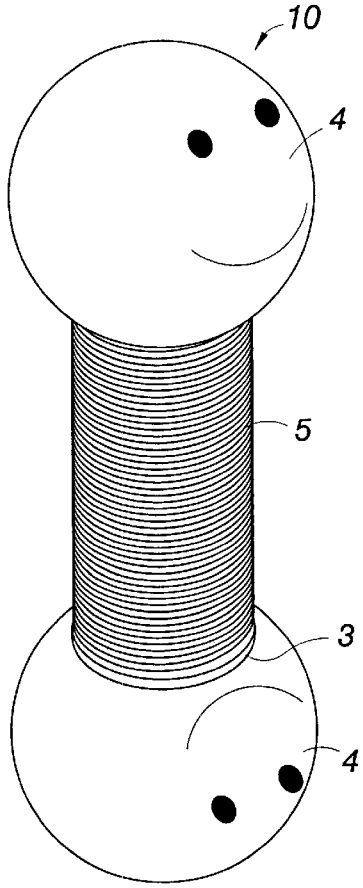
FIG. 5 is the stereo assembly of the jumping toy of the invention.
Figure 6:
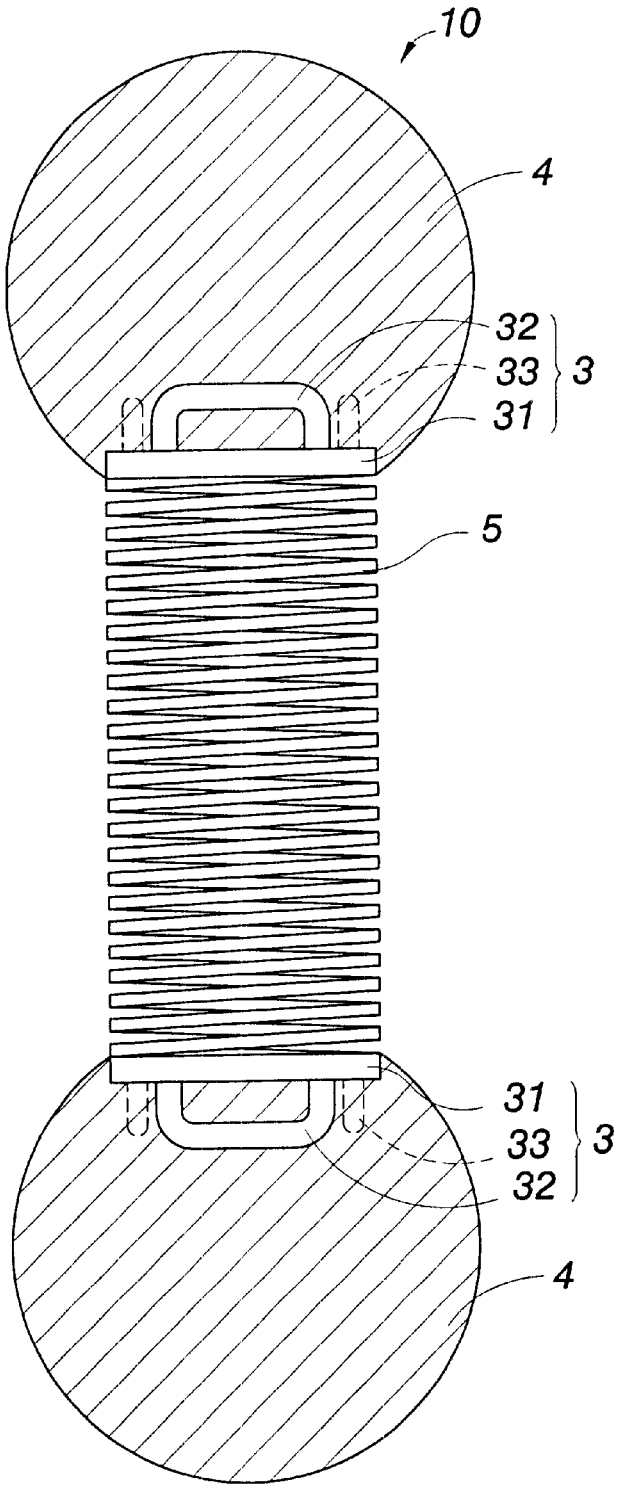
FIG. 6 is the cross section of the jumping toy of the invention.

The FIG. 4 shows the stereo disassembly of the jumping toy of the invention where the jumping toy 10 consists of a extendible spring coil 5, two connectors 3, two adhesive bodies 4. After complete assembly, the profile is indicated in the FIG. 5. The FIGS. 4 and 6 exhibit the cross section of the jumping of the invention, in which, the jumping toy 10 is assembled by a spring coil 5, connectors 3 and adhesive bodies 3.

The connectors have a bottom ring 31, with a protruded arch 32 and a plurality of posts 33. When the posts are plugged into the adhesive bodies 4, and fixed there firmly in place. The protruded arch 32 permits the penetration and steadfast engagement of the adhesive bodies 4. The adhesive bodies further tenaciously hold the connectors 3 and the spring coil 5 together. The spring coil is made from the plastic or metal stripes with superb extendibility. The adhesive bodies are of soft oily silicone rubber composite with slight viscosity. A proper mold is used to smelt the silicone rubber composite and the connectors are submerges into the smelted silicone rubber. After cooled down, the protruded arch 32 and the posts 33 are integrated with the connectors 3.

Please refer to the FIGS. 7~1 and 2 which is the true characteristic diagram of the jumping toy of the invention. Where in jumping toy 10 is hanging on the air, the center works as a pivot and the adhesive bodies 4 are heavier at two ends that will naturally drop to stretch and bend the spring coil 5. However, when the jumping toy is attaching to a smooth vertical surface, the continues actions it performs are in different manner as shown in the FIG. 8.

As shown in the FIGS. 8-1 through 8-8; the jumping toy of the invention is working on a smooth vertical surface (such as glass plate, mirror, plastic, metal or enamel panel). For easy identification and explanation, the two adhesive bodies, one is labeled as 4, and the other as 4', whereas the adhesive body 4 is in white, and the adhesive body 4' is colored (the net symbol is used to indicate the color in the drawing.) Now look at the FIG. 8-1, when the jumping toy is hurled toward the vertical surface 6, both adhesive bodies 4 and 4' will stick to the vertical surface 6. Now come to the FIG. 8-2. Due to the weight effect, the adhesive body 4 above the adhesive body 4' will be the first to disengage the surface 6. As shown in the FIG. 8-3, both adhesive bodies 4 and 4' will disengage the vertical surface 6 on the account of the weight effect, and the pulling force exerted by the spring coil 5. While the adhesive bodies 4 and 4' fall freely down, roll and rotate, at this instant moment, the spring coil 5 exercises extension and bias turning, causing the adhesive body 4' to stick to the vertical surface 6 again as shown in the FIG. 8-4. Now the adhesive body 4' acts as a pivot, causing the adhesive body 4 to turn and roll as illustrated in the FIG. 8-5. When rolling and rotating, the adhesive body 4 is also restricted by traction resistance and torque imposed by the spring coil 5 to produce a swing action like a pedant, and final stick to the vertical surface 6 again as shown in the FIG. 8-6. In this instance, the adhesive body 4' is above the adhesive body 4, and spring coil will be pulled and extended. The adhesive body 4' will, in the ways similar to the precedent description, begin to move downward as shown in the FIGS. 8-7 and -8. These two adhesive bodies, influenced under adhesion, spring extension and torque, weight, gravitation, will produce irregular continuous rolling, swinging, and jumping, all on lookers will laugh when looking at it.

In the meantime, it is assured that these two adhesive bodies 4 and 4' will never fall freely simultaneously because the air resistance, the torque and, recoiling force will keep one of two adhesive bodies sticking to the vertical surface from time to time. Once the jumping toy 10 attaches to the vertical surface, it produces free drop, irregular rolling, turning, jumping and eventually falling to the ground.

Figure 9:
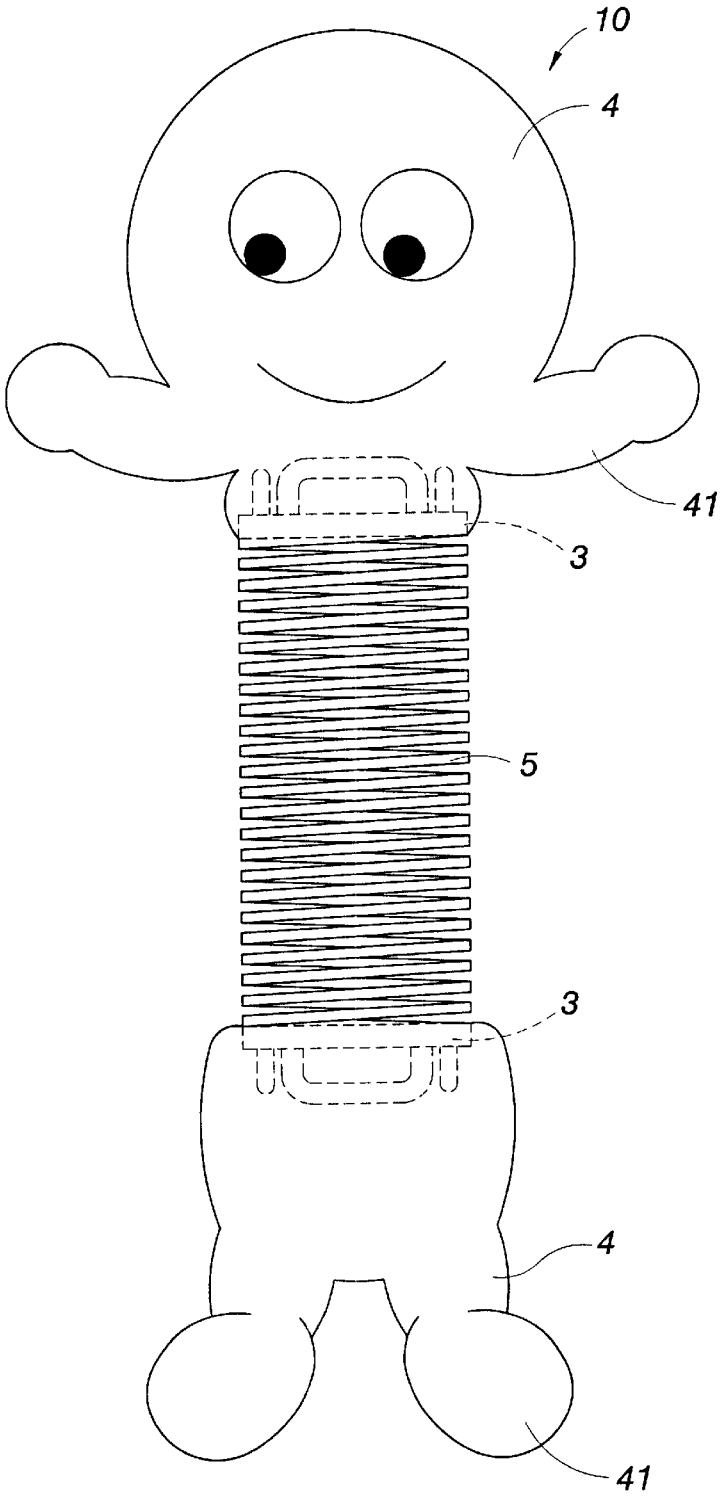
FIG. 9 shows another embodiment of the jumping toy of the invention.

The FIG. 9 shows another embodiment of the jumping toy of the invention where adhesive bodies of the jumping toy can be made in a variety of patterns, such cartoon figure, animal, ET in an attempt to enlarge the recreational efficiency. More effectively, the extended parts such as arm and leg will enhance the swing and rolling effect for the jumping toy 10.

What is claimed is:

1. An adhesive funny jumping toy comprises:

a spring coil with two ends;

two connectors, each separately located at each end of the spring coil, each connector in the form of a bottom ring with a plurality of upright posts and protruded arch;

two adhesive bodies being viscous oily soft silicon rubber composites, each fastened to one of said connectors where said posts are plugged into the adhesive body and the protruded arch penetrates the adhesive body to become an integral part thereof; so that the assembled jumping toy when thrown against a smooth vertical surface will roll and irregularly jump along the surface by influence of adhesion of the adhesive bodies, the spring coil recoil and gravity.

2. The adhesive funny jumping toy of claim 1 wherein the adhesive bodies have at least one extension to enhance irregular movement down a wall.

* * * * *